United States Patent [19]

Iwaki et al.

[11] 3,931,705

[45] Jan. 13, 1976

[54] COUNTER FEED MECHANISM AS USED IN DIGITAL CLOCK

[75] Inventors: Koichi Iwaki, Hino; Atsushi Wakabayashi, Gyoda; Yukihiro Nagahori; Shiro Nakagawa, both of Tokyo, all of Japan

[73] Assignee: Jeco Kabushiki Kaisha, Japan

[22] Filed: June 24, 1974

[21] Appl. No.: 482,421

[30] Foreign Application Priority Data

June 26, 1973 Japan ..... 48-75097[U]
June 26, 1973 Japan ..... 48-75098[U]
June 26, 1973 Japan ..... 48-75099[U]

[52] U.S. Cl. ..... 58/125 C; 58/126 E; 235/133 R; 235/134; 235/103; 235/104; 74/1.5

[51] Int. Cl.[2] ..... G04B 19/02

[58] Field of Search ..... 58/125 C, 126 E, 46 R, 58/40, 41 B, 48; 235/144 MA, 137, 136, 133 R, 139 R, 103, 104, 134; 74/1.5

[56] References Cited

UNITED STATES PATENTS 2,336,307 12/1943 Slye ..... 235/139 R X
3,369,747 2/1968 Devanney ..... 235/133 R
3,590,571 7/1971 Niznik ..... 58/125 C

*Primary Examiner*—George H. Miller, Jr.
*Assistant Examiner*—U. Weldon
*Attorney, Agent, or Firm*—Wolfe, Hubbard, Leydig, Voit & Osann, Ltd.

[57] ABSTRACT

The present invention relates to a counter feed mechanism as used in digital clock comprising a cam member adapted for advanced rotation and another cam member adapted for delayed rotation both arranged on a common axis so that the advanced rotation of the first-mentioned cam member under a drive force transmitted from a clock mechanism twists a coil spring stretched between both cam members, which is, in turn, charged with energy for rotation of the second-mentioned cam member and, upon rotary displacement of the first-mentioned cam member by a predetermined angle, said second cam member is released to be rotated at once so as to advance a rotary wheel step by step.

8 Claims, 19 Drawing Figures

Fig - 5a
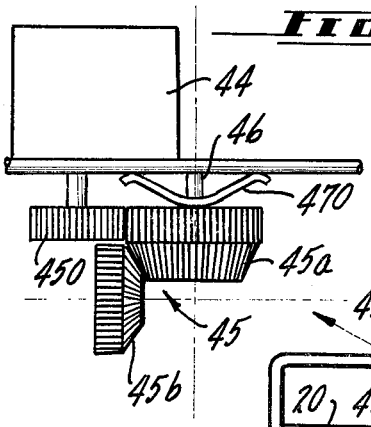
Fig - 5
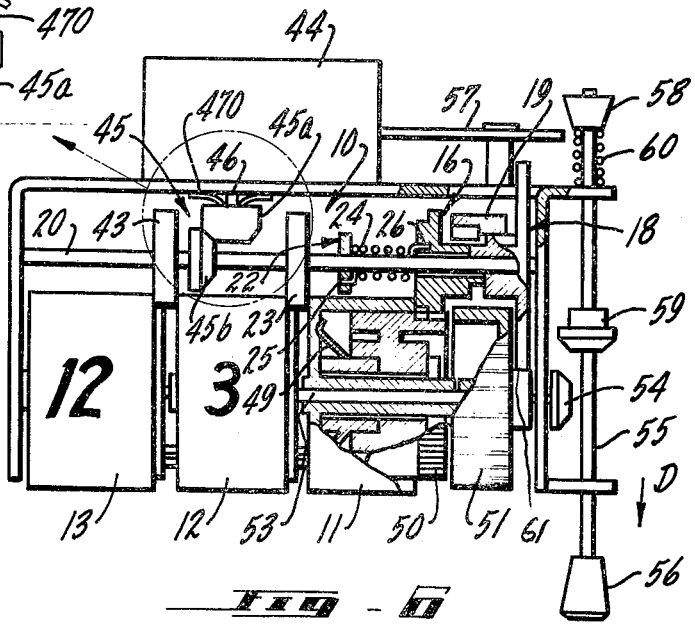
Fig - 6
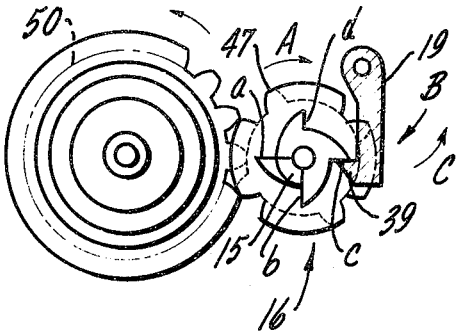
Fig - 7
Fig - 8
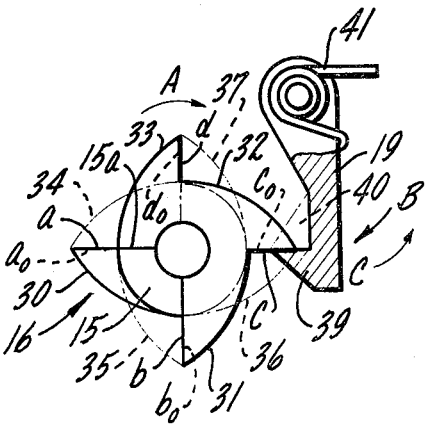
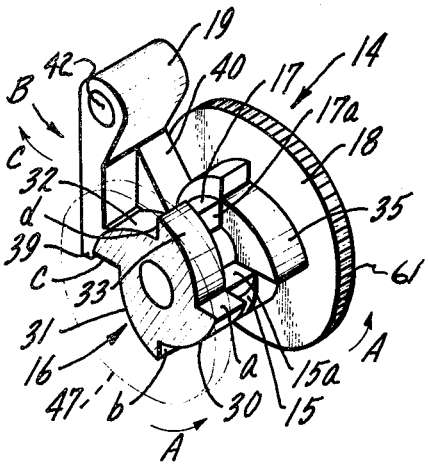

COUNTER FEED MECHANISM AS USED IN DIGITAL CLOCK

SUMMARY OF THE INVENTION

The present invention relates to a counter feed mechanism particularly as used in the digital clock using a battery as its power source.

The first object of the present invention is to operate in a transmittent manner the rotary wheels forming together a time display drum assembly with a reliable drive torque.

The second object is to minimize a drive sound or an impact sound at the moment of each intermittent rotation of the rotary wheels.

The third object is to provide perfect change-over of a display on the rotary wheels serving as the time display drum assembly.

The fourth object is to prevent a first order minute display drum from being rotated backward in adjustment of a displayed time.

The fifth object is to prevent an operation display wheel from momentarily pausing (ceasing to rotate) during operation.

BACKGROUND OF THE INVENTION

Although there have already been proposed various types of feed mechanism for the digital counter, most of them have conventionally been of the motor driven type using commercial AC and encountered no problem of obtaining a drive torque for the rotary wheels serving as the time display drum assembly.

In the DC digital clock using a battery as its drive source, however, a necessary restriction on the available current has raised an inconvenience in that the output torque is so small that it is difficult to drive the drum assembly reliably. An improved feed mechanism which may be effectively operated at an improved efficiency or at a lower torque has been seriously needed.

There has also been a serious need for elimination or minimization of an impact sound possibly generated at the moment that the first order minute display drum is intermittently driven or comes to rest.

To overcome the above mentioned drawbacks, the present invention provides an improved counter feed mechanism which is of low cost and can be reliably operated with a negligible drive sound as well as being a relatively light load.

BRIEF DESCRIPTION OF THE DRAWINGS

FIGS. 1 to 4 illustrate a first embodiment of the mechanism constructed according to the present invention, of which FIG. 1 is a perspective view of said mechanism, FIG. 2 is a perspective view showing important parts thereof when dismantled, FIG. 3 is a view similar to FIG. 2 but as seen in the other direction, FIG. 3*a* schematically shows relative positions of stopper associated with the first- and second-mentioned cam members, respectively, and FIG. 4 is a schematic diagram illustrating the manner in which said mechanism operates;

FIGS. 5 to 9 illustrate a second embodiment of the mechanism according to the present invention, of which FIG. 5 is a plan view showing said mechanism partially in section through the important parts thereof, FIG. 5*a* illustrates bevel gears and crown gears in detail, FIG. 6 is a side view showing Geneva gears, FIG. 7 is an enlarged perspective view of cams, FIG. 8 is a side view of cams, and FIG. 9 is a side view partially broken away of the other Geneva gear;

FIGS. 10 to 13 illustrate a third embodiment of the mechanism according to the present invention, of which FIG. 10 is a perspective view thereof, FIG. 11 is a perspective view showing important parts thereof as dismantled, FIG. 12 is a view similar to FIG. 11 but as seen in the other direction, and FIG. 13 is a side view partially broken away of said important parts; and FIGS. 14 to 16 illustrate a fourth embodiment of the mechanism according to the present invention, of which FIG. 14 is a perspective view, FIG. 15 is a perspective view showing important parts as dismantled, and FIG. 16 is an enlarged perspective view showing said important parts.

DETAILED DESCRIPTION OF PREFERRED EMBODIMENTS

Figure 1:
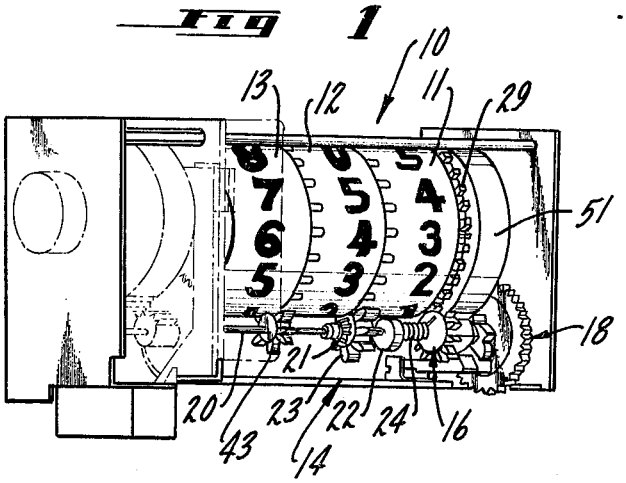
Figure 2:
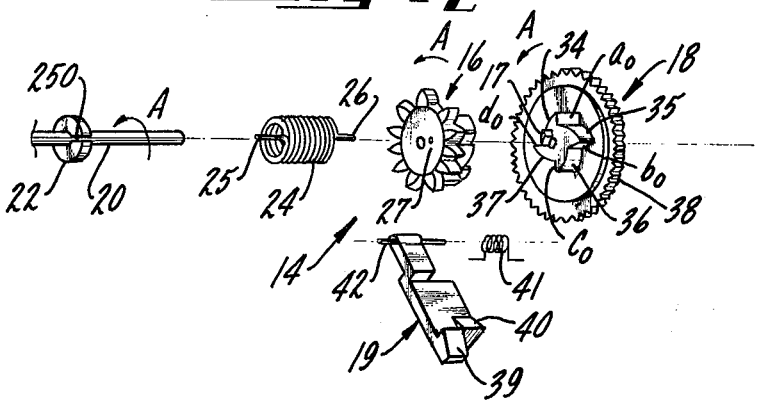

Now the first embodiment will be described with reference to FIGS. 1 to 4. A reference numerical 10 designates a counter body including rotary wheels 11, 12 and 13 well known in themselves which serve as the first order minute display wheel, the second order minute display wheel and an hour display wheel, respectively, when they are practically used in a digital clock. These rotary wheels 11, 12 and 13 are intermittently driven by an intermittent drive mechanism 14 under a rotary drive force provided from a clock mechanism (not shown). The intermittent drive mechanism 14 principally comprises a first cam member 16 which is provided with a stopper 15 and adapted for delayed rotation, a second cam member 18 which is provided with a stopper 17 and adapted for advanced rotation, and a lock lever 19. A reference numeral 20 designates a rotary shaft on which a drive gear 21 is mounted in unison therewith so that the rotary shaft 20 also is rotated as said drive gear 21 is driven by the clock mechanism (not shown). The rotary shaft 20 has a spring anchor 22 and said second cam member 18 both integrally secured thereon. Feed change gears 23, 43, a coil spring 24 and the first cam member 16 are loosely mounted around the rotary shaft 20, respectively. The coil spring 24 is anchored at an end 25 engaged into a groove 250 of the spring anchor 22 and at the opposite end 26 engaged into an opening 27 of the first cam member 16. As the rotary shaft 20 is rotated in the direction as indicated by an arrow A, the spring anchor 22 is also rotated in the same direction and thereby the coil spring 24 is twisted so as to be charged with a restoring force until the first cam member 16 loosely mounted on the rotary shaft 20 is released from a locking effect by the other member. When released from the locking effect by the other member, the first cam member 16 is displaced at once in the direction as indicated by the arrow A by a predetermined angle under said restoring force charged in the coil spring 24 and thereby advances the rotary wheel 11 by one step. A reference numeral 28 designates teeth formed on the first cam member 16, which are engaged with teeth 29 associated with the rotary wheel 11. The rotary wheel 11 is connected through a slip mechanism (not shown) to said teeth 29. Reference numerals 30, 31, 32 and 33 designate cam portions of the first cam member 16 which are associated with cam steps *a*, *b*, *c* and *d*, respectively, arranged at an angular interval of 90°. The stopper 15 laterally projects from the cam portion 30 and bears against the stopper 17 of the second cam member 18 so as to regulate a rotational angle of the cam members 16. Reference numerals 34, 35, 36 and 37 designate cam portions of the second cam member 18 which are associated with cam steps $a_o$, $b_o$, $c_o$ and $d_o$, respectively, arranged at an angular interval of 90°. The stopper 17 laterally projects from the cam portion 34 and bears against, as previously mentioned, the stopper 15 of the first cam member 16. A reference numeral 38 designates teeth formed on the second cam member 18. A reference numeral 30 designates a first locking portion of the lock lever 19 which is adapted to be engaged with any one of the cam steps *a*, *b*, *c*, and *d* associated with the cam portions 30, 31, 32 and 33, respectively, of the first cam member 16. A reference numeral 40 designates a second locking portion of the lock lever 19 which is adapted to be engaged with any one of the cam steps $a_o$, $b_o$, $c_o$, and $d_o$ associated with the cam portions 34, 35, 36 and 37, respectively, of the second cam member 18. The lock lever 19 is normally biased by a coil spring 41 in the direction as indicated by an arrow B and has the locking portions engaged with the associated cam steps.

As the rotary shaft 20 is rotated in the direction as indicated by the arrow A, the second cam member 18 is also rotated in the same direction together therewith. The coil spring 24 stretched between the spring anchor 22 being rotated in the direction of the arrow A and the first cam member 16 which is still blocked against rotation is now twisted and thereby charged with a restoring force. As the second cam member 18 is rotated in the direction of the arrow A, the second locking portion 40 of the lock lever 19 which is engaged with the cam step $c_o$ of the cam portion 36 is angularly displaced by the cam edge of the cam portion 37 around a pivot 42 in the direction as indicated by an arrow C. Thus, the lock lever 19 is angularly displaced in against a biasing effect of the coil spring 41 acting in the direction of the arrow B and thereby the first locking portion 39 which is engaged with the cam step *b* of the cam portion 31 of the first cam member 16 is now disengaged from said cam step *b*. As a result, the first cam member 16 is rotated in the same direction under the effect of the coil spring 24 and thereby the second locking portion 40 of the lock lever 19 falls along the cam edge of the cam portion 37 into the cam step $d_o$. Thus, the first cam member 16 is rotated at once by an angle of 90° in the direction of the arrow A under the restoring force of the coil spring 24, and the stopper 15 laterally projecting from the cam portion 30 of the first cam member 16 bears against the stopper 17 laterally projecting from the cam portion 34 of the second cam member 18 so that said second cam member 18 is stopped. In such a way the rotary wheel 11 is advanced by one step under action of the teeth 28 on the first cam member 16 through the teeth 29. Such an operation will be repeated thereafter. A reference numeral 23 designates a feed change gear loosely mounted on the rotary shaft 20 so that the rotary wheel 12 may be angularly displaced by one step for every rotation of the rotary wheel 11. Another feed change gear 43 advances the rotary wheel 13 by one step in the similar manner.

The manner in which the embodiment of the arrangement as mentioned just above operates will be now described.

As the drive gear 21 is rotated by the clock mechanism (not shown) in the direction of the arrow A, the rotary shaft 20 is also rotated in the same direction. As a result, the second cam member 18 is also rotated in the same direction and the coil spring 24 is twisted so as to be charged with a restoring force. As the second cam member 18 is further rotated in the direction of the arrow A, the second locking portion 40 of the lock lever 19 which has fallen into the cam step $c_o$ of the cam portion 36 is now lifted by the cam edge of the cam portion 37, so that the lock lever 19 retracts around the pivot 42 in the direction of the arrow C. Consequently, also the first locking portion 39 of the lock lever 19 which has fallen into the cam step *c* of the cam portion 32 in the first cam member 16 is now disengaged from the cam step *c*, releasing the first cam member 16 from a locking effect. Thus, the second cam member 18 is rotated in the direction of the arrow A and the second locking portion 40 of the lock lever 19 now falls into the cam step $d_o$ of the cam portion 37.

The first locking portion 39 of the lock lever 19 has been disengaged from the cam step *c* of the cam portion 32 in the first cam member 16 as mentioned above, so that the first cam member 16 is rotated at once by an angle of 90° in the direction of the arrow A under a restoring force of the coil spring 24 and stopped as the following stopper 15 bears against the advanced stopper 17. The rotary wheel 11 is thereby advanced by one step through action of the teeth 28 and 29. Such an operation will be repeated thereafter.

The second embodiment will be described with reference to FIGS. 5 to 9. The parts included in this embodiment that are substantially similar to those included in the first embodiment are designated by the same reference numerals.

This embodiment effectively eliminates drawbacks of the first embodiment which will be described below.

First, the first cam member 16 usually involves two-stage-operation consisting of a momentary rotation and a rotation at reduced velocity in operative connection with a clock mechanism 44, so that the displayed time is changed over disadvantageously through two-stage-operation. Second, rotation for adjustment of a displaced time is transmitted to the first cam member and thereby the coil spring 24 is charged so that, after adjustment of the displayed time, said first cam member 16 is rotated back by an angle through which said coil spring 24 has been twisted and a corresponding "relapse" appears in the displayed time.

The first and second drawbacks as mentioned just above are effectively overcome by this embodiment in which there is provided an intermittent rotation mechanism such as a Geneva gear between the first cam member 16 and the rotary wheel 11.

Third, there may occur a phenomenon that the operation display drum momentarily pauses (takes a breath) and this phenomenon would make the user feel uneasy and anticipate a trouble. This drawback is effectively overcome by this embodiment in which there is provided between the first cam member and the clock mechanism bevel gears or crown gears any one of which is subjected to a spring pressure acting in the axial direction so that a backlash between the second cam member 18 and the clock mechanism 44 may be eliminated and said momentary pause (or taking a breath) may be avoided. This phenomenon of taking breath may be due to a cause as described below.

As the first cam member 16 is rotated by the coil spring 24 upon rotation of the lock lever 19 by a predetermined angle, the stopper 15 forces the stopper 17 of the second cam member 18 in the direction of the positive rotation under an effect of the coil spring 24 acting in the direction of said positive rotation so that an advanced rotation of the second cam member 18 corresponding to said backlash is provided and both cam members 16, 18 cease to rotate for a time corresponding to said backlash. Thus, the operation display drum 51 connected to said both cam members 16, 18 momentarily ceases to rotate or take a breath. The second embodiment may effectively eliminate this drawback which has usually been encountered by the mechanism of prior art.

Features of this embodiment will now be described in detail but description of substantially the same operation as that of the first embodiment will not be repeated here.

Figure 9:
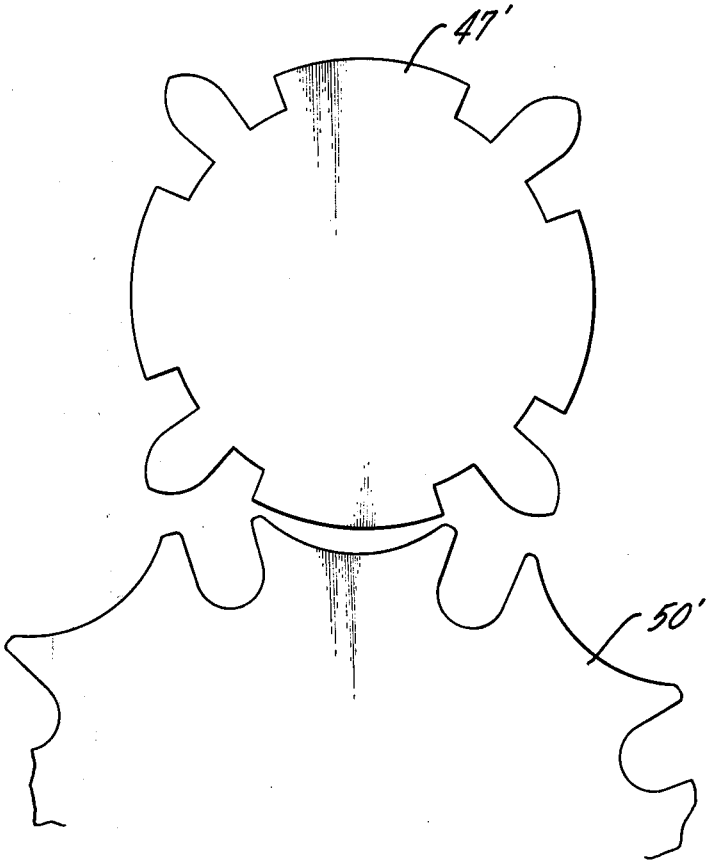
Figure 10:
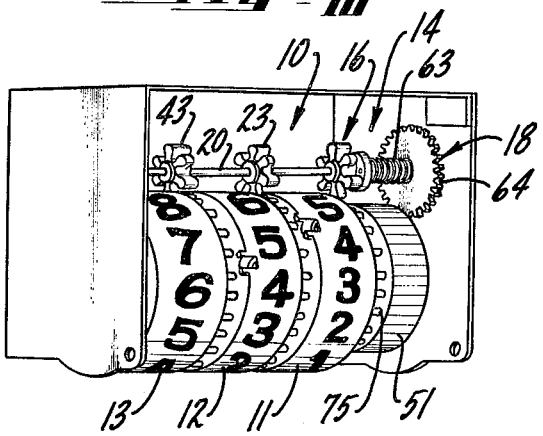
Figure 11:
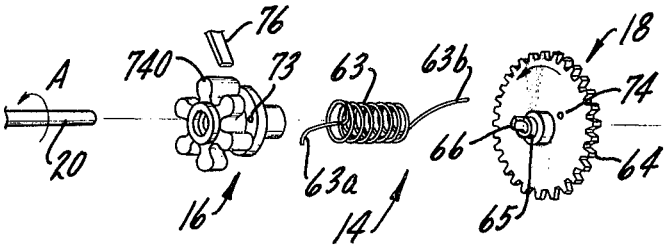

A reference numeral 44 designates the clock mechanism with which the counter body 10 is provided and the rotary shaft 20 has the first cam member 16 as the cam member for delayed rotation loosely mounted thereon and the second cam member 18 as the cam member for advanced rotation integrally mounted thereon. Said rotary shaft 20 is rotatably connected through bevel gears or crown gear 45 and an intermediate gear 450 to said clock mechanism 44. The one 45*a* of said bevel gears 45 that is located on the drive side or the side of said clock mechanism 44 is loosely mounted on a shaft 46 with its mating surface biased by a leaf spring 470 against the bevel gear 45*b* on the follower side which is fixedly mounted on the rotary shaft 20. A rotational force transmitted from the clock mechanism 44 is further transmitted through an intermediate gear 450 to said bevel gears 45*a*, 45*b* and said rotary shaft 20. The coil spring 24 is connected at one end 25 to the spring anchor 22 fixedly mounted on the rotary shaft 20 and at the other end 26 to said first cam member 16. The first cam member 16 is formed at one end with a drive side Geneva gear 47 or 47' as shown by FIG. 6 or 9 and at the other end with the cam portions 30 to 32 and the stopper 15.

Said drive side Geneva gear 47 together with a follower side Geneva gear 50 or 50' operatively connected through a slip mechanism 49 to the rotary wheel 11 serving as the first order minute display drum forms the intermittent rotation mechanism in which, upon rotation of said drive side Geneva gear 47 by a predetermined angle, the follower side Geneva gear 50 is momentarily rotated by a predetermined angle corresponding to a single graduation (1 minute) of said rotary wheel 11.

Figure 3A:
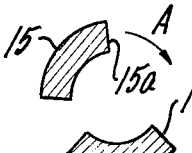
Figure 3:
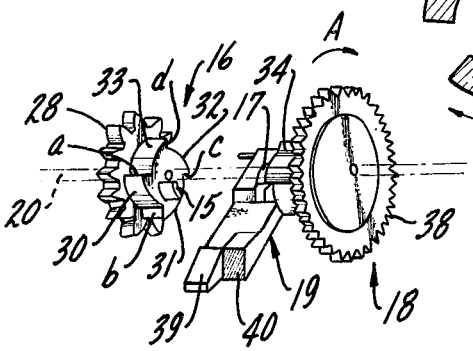
Figure 4:
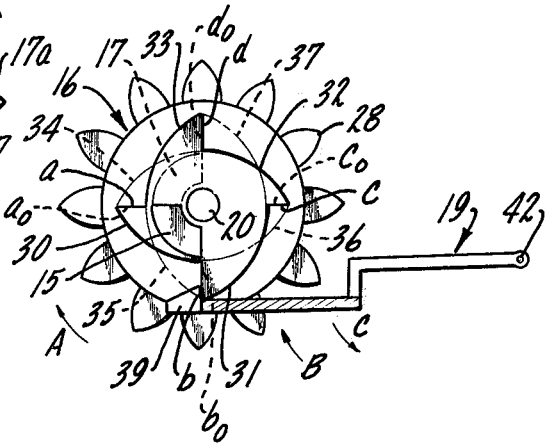

The cam portions 30 to 33 have their respective cam steps *a*, *b*, *c* and *d* all facing in the direction of rotation and constitute a spiral cam. The stopper 15 has an end surface 15*a* (see FIG. 3*a*) flush with the cam step *a* of said cam portion 30. The second cam member 18 is formed with teeth 61 operatively connected to an operation display drum 51 and at one side with cam portions 34 to 37 and the stopper 17 in opposition to the cam portions 30 to 33 of said first cam member 16. The cam portions 34 to 37 have their respective cam steps $a_o$, $b_o$, $c_o$ and $d_o$ all facing in the direction opposite to rotation and constitute another spiral cam. The stopper 17 has an end surface 17*a* (see FIG. 3*a*) adapted to bear against the end surface 15*a* of said stopper 15 and thereby to regulate a rotational angle of said first cam member 16. The lock lever 19 is integrally formed with a second locking portion 40 adapted to be engaged with any one of the cam steps $a_o$ to $d_o$ of the cam portions 34 to 37, respectively, and a first locking portion 39 adapted to be engaged with any one of the cam steps *a* to *d* of said cam portions 30 to 33, respectively. The lock lever 19 is supported at one end around the pivot 42. The coil spring 41 biases the lock lever 19 normally against the cam portions 30 to 33, on one hand, and against the cam portions 34 to 37, on the other hand. A reference numeral 53 designates a drum shaft on which the rotary wheel 11 is fixedly mounted while said operation display drum 51, the rotary wheel 13 serving as the hour display drum and the rotary wheel 12 serving as the second order minute display drum are loosely mounted. An adjustor wheel 54 is fixedly mounted on one end of said drum shaft 53. A reference numeral 55 designates an adjustor shaft integrally provided at one end with an adjustor knob 56, at the other end with a starter cam 58 serving as an actuator for a starter 57 and at an intermediate portion with an adjustor pinion 59 engaged with said adjustor wheel 54. A reference numeral 60 designates a restoring spring for the adjustor shaft 55.

The manner in which the second embodiment of the arrangement as mentioned above operates will be now described.

When the adjustor knob 56 is pulled in the direction as indicated by the arrow D and then released, the starter cam 58 causes the starter 57 to oscillate and thereby the clock mechanism 44 is activated, so that the rotary shaft 20 is rotated through the bevel gears 45. The coil spring 24 connected at one end with the first cam member 16 of which the cam step *c* is engaged with the first locking portion 39 of the lock lever 19 is now charged with a rotation force as the rotary shaft 20 is rotated. The second cam member 18 is, on the other hand, rotated in the direction of the arrow A in unison with the rotary shaft 20 and gradually lifts the lock lever 19 in the direction of the arrow C. When said lock lever 19 has been lifted by a predetermined amount, the first locking portion 39 of said lock lever 19 is disengaged from the cam step *c* of the cam portion 32 and simultaneously the first cam member 16 is rotated in the direction of the arrow A under a force charged in the coil spring 24 until the end surface 15*a* of the stopper 15 bears against the end surface 17*a* of the stopper 17 opposed to said end surface 15*a*. Said first cam member 16 is rotated under action of the coil spring 24 together with the second cam member 18 even after being momentarily stopped upon contact between said stoppers 15 and 17 until the second locking portion 40 of the lock lever 19 falls into a predetermined step of a predetermined cam portion of the second cam member 18 and the first locking portion 39 of said lock lever 19 falls into predetermined cam step of a predetermined cam portion of the first cam member 16.

As mentioned above, the follower side Geneva gear 50 is rotated first after delayed rotation of the first cam member 16 and the rotation of said Geneva gear 50 causes the rotary wheel 11 to be rotated. There may be provided another arrangement such that the momentary rotation of the first cam member 16 also rotates said follower side Geneva gear. The rotation of said rotary wheel 11 is, as well known, successively transmitted to the rotary wheels 12 and 13. The operation display drum 51 is continously rotated by the clock mechanism 44 together with the second cam member 18.

In adjustment of the displayed time, the adjustor knob 56 may be pulled and rotated with the adjustor pinion 59 engaged with the adjustor wheel 54 so that the rotary wheel 11 be rotated through the drum shaft 53 together with said adjustor wheel 54 to the position corresponding to a correct time. The first cam member 16 is cut off at this time point from any rotation transmitted thereto under the function peculiar to the Geneva gears 47 and 50 for prevention of the reverse rotation and a frictional coupling is established between the rotary wheel 11 and the slip mechanism.

As described hereinbefore, the present invention is based on the principle that cooperation of the first cam member 16 with the second cam member 18 and the lock lever 19 causes the coil spring 24 to be charged with a drive torque for the rotary wheels 11, 12 and 13 and thereby the time display drum is intermittently rotated by the clock mechanism of a simple construction as well as of a low torque. Furthermore, in accordance with the present invention, the "two-stage-operation" and relapse of the displayed time is eliminated by use of the intermittent rotation mechanism such as a Geneva gear. Moreover, the elements such as the bevel gear, the crown gear and the leaf spring may effectively eliminate the backlash and the breath of the operation display drum according to the present invention.

The third embodiment will be described in reference with FIGS. 10 to 13. The parts are substantially the same as those in the first and second embodiments and are designated by the reference numerals common thereto.

The counter body 10 is provided with the rotary wheels 11, 12 and 13 which are intermittently driven by the intermittent drive mechanism 14 under a drive force provided from the clock mechanism (not shown). The intermittent drive mechanism 14 principally comprises the second cam member 18 adapted for advanced rotation, the first cam member 16 adapted for delayed rotation and a coil spring 63 adapted to bias said cam members 18 and 16 so that both these cam members normally bear against each other on a common axis. The second cam member 18 has teeth 64 to which a drive force is transmitted from the clock mechanism (not shown). The second cam member 18 is fixedly mounted on the rotary shaft 20 in such a manner that said second cam member may be rotated together with said rotary shaft 20. The first cam member 16 is loosely mounted on the rotary shaft 20. A reference numeral 65 designates a cam stem consisting of a sleeve which is partially broken away in the axial direction and has its forward end 66 obliquely cut off so as to be formed into a slant edge 67. Reference numerals 68 and 68 *a* designate cut-off edges of the cam stem 65 formed by a sleeve axially broken away. A reference numeral 69 designates a cam sleeve of the first cam member 16, within which a spiral cam portion 70 having a diameter corresponding to the inner diameter of said sleeve is formed. Reference numerals 71, 71*a* and 72 designate a first cam step, a second cam step and a cam edge, respectively. With the cam stem 65 of said second cam member 18 loosely inserted into the cam sleeve 69 of said first cam member 16, the cut-off edge 68 of said cam step 65 is biased by the coil spring 63 against the first cam step 71 of the spiral cam portion 70 in said cam sleeve 69 and the slant edge 67 is forced against the cam edge 72 under a tensile force of said coil spring 63 arranged between both cam members 18 and 16. Said coil spring 63 will be described later in more detail. Relative rotation of the second and first cam members 18 and 16 causes, therefore, the coil spring 63 to be charged, and said first cam member 16 is displaced in the direction of the arrow B due to a relationship between the cam stem 65 and the spiral cam portion 70. A reference numeral 73 designates an anchoring hole provided in the first cam member 16, into which is inserted and anchored one end 63*a* of the coil spring 63 of which the other end 63*b* is inserted and anchored into another anchoring hole 74 provided in the second cam member 18. A tensile force of the coil spring 63 establishes the state that the first and second cam members 16 and 18 bear against each other. A reference numeral 740 designates teeth of the first cam member 16 which are adapted to be engaged with teeth 75 of the rotary wheel 11. A reference numeral 76 designates a stopper to regulate the angle through which the first cam member 16 may be rotated. The stopper 76 is normally engaged with the teeth 740 to prevent the first cam member 16 from being rotated and, upon displacement of said first cam member 16 in the direction of the arrow B, disengaged from said teeth 740 to allow said first cam member 16 to be rotated at once by a predetermined angle.

The manner in which the third embodiment of the arrangement as mentioned above operates will be described below.

The rotary shaft 20 is rotated by the clock mechanism (not shown) and thereby the advanced rotation of the second cam member 18 occurs in the direction of the arrow A. This advanced rotation of the first cam member 16 causes the cut-off edge 68 of the cam stem 65 to be disengaged from the first cam step 71 of the spiral cam portion 70 in said first cam member 16 and simultaneously causes the slant edge 67 of said cam stem 65 to be rotated in slidable contact with the cam edge 72 of said spiral cam portion 70. As said slant edge 67 is rotated, the second cam member 18 twists the coil spring 63 and displaces the first cam member 16 in the direction of the arrow B. The first cam member 16, extends the coil spring 63 by the spiral cam portion 70 thereof and is simultaneously displaced in the direction of the arrow B. Such a displacement of said first cam member 16 in the direction of the arrow B causes said first cam member 16 to be disengaged from the stopper 76, so that said first cam member 16 is rotated at once under a force of the previously charged coil spring 63 in the direction of the arrow A and simultaneously pulled by a compressive force of said coil spring 63 in the direction of the arrow C. Thus, the next tooth 740′ bears against said stopper 76 and thereby the first cam member 16 is restrained against further rotation. As the first cam member 16 is rotated at once in the direction of the arrow A, the rotary wheel 11 is advanced by cooperation of the teeth 75 of said rotary wheel 11 with the teeth 740 of said first cam member 16. Such an operation will be repeated thereafter.

Figure 16:
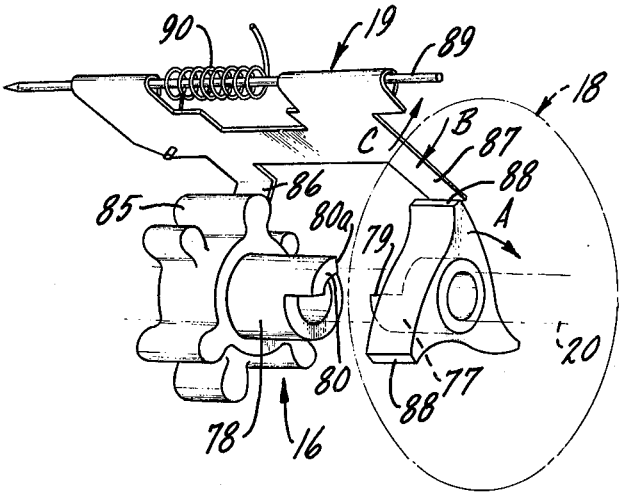
Figure 16A:
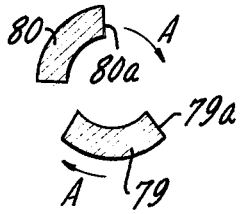
Figure 12:
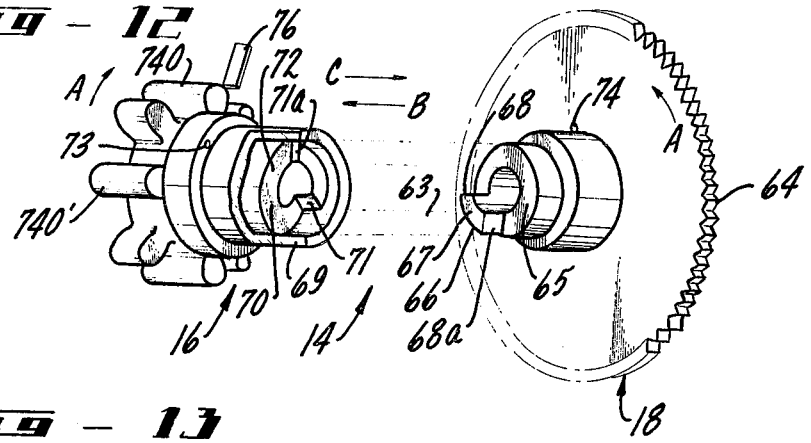
Figure 13:
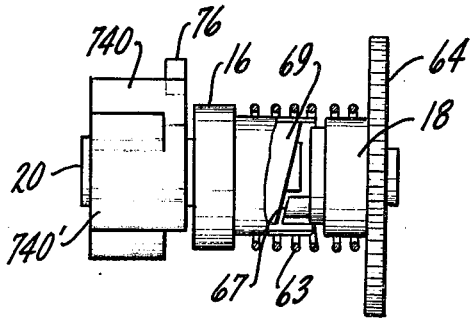
Figure 14:
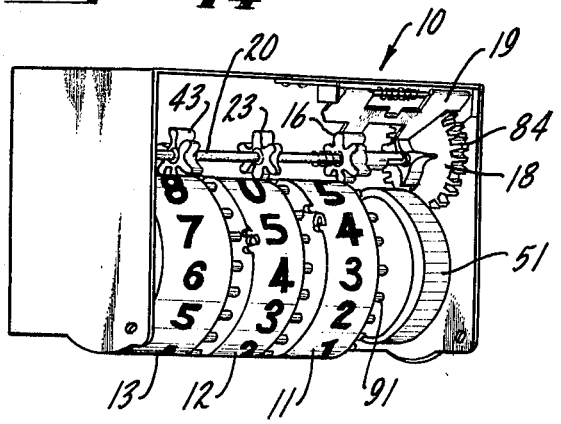
Figure 15:
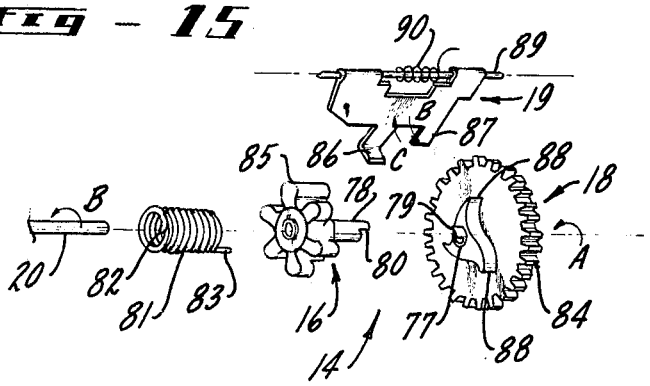

The fourth embodiment will be now described with reference to FIGS. 14 to 16. Parts substantially the same as those in the first, second and third embodiments are designated by reference numerals common thereto. The counter body 10 is provided with the rotary wheels 11, 12 and 13 which are intermittently driven by the intermitten drive mechanism 14 under a drive force provided from the clock mechanism (not shown). The intermittent drive mechanism 14 principally comprises the second cam member 18 adapted for advanced rotation, the first cam member 16 adapted for delayed rotation and the lock lever 19. The second cam member 18 is fixedly mounted by a sleeve 77 on the rotary shaft 20 in a manner such that said rotary shaft 20 is rotated together with said second cam member 18 as the latter is driven by the clock mechanism (not shown). The first cam member 16 is loosely mounted by a sleeve 78 on the rotary shaft 20. A reference numeral 79 designates a stopper formed by peripherally cutting three quarters of said sleeve 77 away. A reference numeral 80 designates another stopper formed by peripherally cutting three quarters of said sleeve 78 away. The stoppers 79 and 80 have respective cut-off end surfaces 79*a* and 80*a* adapted to bear against each other. A reference numeral 81 designates a coil spring which is anchored at one end 82 on the rotary shaft 20 and at the other end 83 on the first cam member 16. As the rotary shaft 20 is rotated, the coil spring 81 is charged with a restoring force so far as the first cam member 16 is restrained by the lock lever 19 against rotation and said second cam member 18 is rotated at once in the same direction as the rotating direction of said rotary shaft 20. Reference numerals 84 and 85 designate teeth of the second and first cam members 18 and 16, respectively. Reference numerals 86 and 87 designate first and second locking portions of the lock lever 19, which are adapted to bear against the teeth 85 of the first cam member 16 and against a cam boss 88 of the second cam member 18, respectively. A reference numeral 89 designates a pivot of said lock lever 19 which normally urges said lock lever 19 in the direction of the arrow B under action of a coil spring 90 against the second cam member 18 and the first cam member 16. A reference numeral 91 designates teeth of the rotary wheel 11. Reference numerals 23 and 43 designate feed change gears adapted to drive the rotary wheels 12 and 13.

The manner in which the fourth embodiment of the arrangement as mentioned above operates will be described below.

The rotary shaft 20 is rotated by the clock mechanism (not shown) and thereby the second cam member 18 is rotated in the direction of the arrow A. The cam boss 88 is urged against the locking portion 87 of the lock lever 19 and thereby said lock lever 19 is forced to retract in the direction of the arrow C. The locking portion 86 is disengaged from the teeth 85 of the first cam member 16 immediately before the locking portion 87 reaches the summit of the cam boss 88, so that the restoring force of the coil spring 81 which has been charged with said restoring force as the rotary shaft 20 is rotated causes the first cam member 16 to be rotated at once in the direction of the arrow A by a predetermined angle. This predetermined angle corresponds to the angle at which the cut-off end surface 79*a* of the stopper 79 formed on the sleeve 77 in the second cam member 18 is brought into contact with the cut-off end surface 80*a* of the stopper 80 of the first cam member 16. As the second cam member 18 is further rotated in the direction of the arrow A, the locking portion 87 of the lock lever 19 is disengaged from the summit of the cam boss 88 and thereby said lock lever 19 is brought back under the restoring force of the coil spring 90 in the direction of the arrow B into a recess 93.

Such an operation will be repeated thereafter.

It is obvious that the present invention is not limited to the specific embodiments as described herebefore in reference with the accompanying drawing and there may be various modifications without departure from the spirit of the invention.

What I claim is:

1. A counter feed mechanism for use in a digital clock comprising in combination, a first cam member adapted for advanced rotation, a second cam member adapted for delayed rotation with respect to said first cam member, both of said cam members being arranged on a common rotational axis, a rotary clock mechanism, means coupling said clock mechanism to said first cam member for rotation of same, spring means coupled to said second cam member and arranged to be charged by rotation of said clock mechanism, lock means engaging said second cam member for preventing rotation thereof, said first cam member including means for releasing said lock means after a predetermined amount of rotation of said first cam member thereby to allow said spring means to advance said second cam member, and a rotary wheel coupled to said second cam member, whereby energizing of said clock mechanism causes said rotary wheel to advance in step by step fashion.

2. A counter feed mechanism according to claim 1 wherein said first cam member includes a cam stem, said second cam member includes a cam sleeve, said cam stem being loosely inserted into said cam sleeve, said sleeve and stem forming a spiral cam adapted to move said second cam member axially with respect to said first cam member, a predetermined amount of axial movement serving to release said second cam member for stepwise rotation under the urging of said spring means.

3. A counter feed mechanism according to claim 2 wherein said spring means comprises a coil spring having a first end connected to said first cam member and a second end connected to said second cam member whereby rotation of said first cam member serves to stretch said spring, said spring serving to urge said cam members together.

4. A counter feed mechanism according to claim 1 wherein said first cam member is operatively connected to an operation display drum, and further including gear means for transmitting rotational drive from said clock mechanism to said first cam member, and second spring means biasing said gear means into mesh thereby to eliminate backlash.

5. A counter feed mechanism for use in a digital clock comprising in combination, a rotational clock mechanism, a first cam member adapted for advanced rotation and operatively coupled to said clock mechanism, a second cam member arranged in opposition to said first cam member and adapted for delayed rotation, a rotary wheel operatively coupled to said second cam member, said first and second cam members being arranged on a common axis, a coil spring coupled between said clock mechanism and said second cam member and adapted to be charged in response to rotation of said clock mechanism, a lock lever adapted to engage both of said cam members, said lock lever serving to restrain rotation of said second cam member, said first cam member serving to angularly displace said lock lever to release said second cam member after a predetermined amount of rotation of said first cam member, thereby to allow rotation of said second cam member under the urging of said spring means to advance the rotary wheel intermittently.

6. A counter feed mechanism according to claim 5 including a Geneva mechanism coupling said second cam member to said rotary wheel.

7. A counter feed mechanism according to claim 5 including a shaft driven by said rotary clock mechanism, said first cam member being secured to said shaft for rotation thereby, said second cam member being loosely mounted on said shaft, said cam members including operatively associated stop members whereby said first cam member sets a limit on rotation of said second cam member after said second cam member is released by said lock lever.

8. A counter feed mechanism according to claim 5 wherein said second cam member includes a plurality of teeth for driving said rotary wheel, said lock lever including a first arm engaging said first cam member and a second arm adapted to be interfitted between the teeth of said second cam member, rotation of said first cam member serving to disengage said second arm from said teeth thereby to release said second cam member, said cam members including interacting stop means for limiting the amount of rotation of said second cam member.

* * * * *

UNITED STATES PATENT AND TRADEMARK OFFICE

CERTIFICATE OF CORRECTION

PATENT NO. : 3,931,705

DATED : January 13, 1976

INVENTOR(S) : Koichi Iwaki; Atsushi Wakabayashi; Yukihiro Nagahori; and Shiro Nakagawa It is certified that error appears in the above-identified patent and that said Letters Patent are hereby corrected as shown below:

On the Cover Page, in the section entitled [30] Foreign Application Priority Data, insert the following:

March 30, 1974 Japan . . . . . P49-36149

Signed and Sealed this

*twenty-seventh* Day of *April 1976*

[SEAL]

*Attest:*

RUTH C. MASON
*Attesting Officer*

C. MARSHALL DANN
*Commissioner of Patents and Trademarks*